US008450040B2

(12) United States Patent
Nosella et al.

(10) Patent No.: US 8,450,040 B2
(45) Date of Patent: May 28, 2013

(54) METHOD FOR CONTROLLING A TONER PREPARATION PROCESS

(75) Inventors: Kimberly D. Nosella, Mississauga (CA); Allan K. Chen, Oakville (CA); Abdisamed Sheik-Qasim, Etobicoke (CA); Melanie L. Davis, Hamilton (CA); Zhen Lai, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 363 days.

(21) Appl. No.: 12/603,991

(22) Filed: Oct. 22, 2009

(65) Prior Publication Data

US 2011/0097664 A1 Apr. 28, 2011

(51) Int. Cl.
*G03G 9/08* (2006.01)

(52) U.S. Cl.
USPC ..... 430/137.14; 430/109.1

(58) Field of Classification Search
USPC ..... 430/137.14, 109.1
See application file for complete search history.

(56) References Cited

U.S. PATENT DOCUMENTS

| | | | |
|---|---|---|---|
| 5,278,020 | A | 1/1994 | Grushkin et al. |
| 5,290,654 | A | 3/1994 | Sacripante et al. |
| 5,308,734 | A | 5/1994 | Sacripante et al. |
| 5,344,738 | A | 9/1994 | Kmiecik-Lawrynowicz et al. |
| 5,346,797 | A | 9/1994 | Kmiecik-Lawrynowicz et al. |
| 5,348,832 | A | 9/1994 | Sacripante et al. |
| 5,364,729 | A | 11/1994 | Kmiecik-Lawrynowicz et al. |
| 5,366,841 | A | 11/1994 | Patel et al. |
| 5,370,963 | A | 12/1994 | Patel et al. |
| 5,403,693 | A | 4/1995 | Patel et al. |
| 5,405,728 | A | 4/1995 | Hopper et al. |
| 5,418,108 | A | 5/1995 | Kmiecik-Lawrynowicz et al. |
| 5,496,676 | A | 3/1996 | Croucher et al. |
| 5,501,935 | A | 3/1996 | Patel et al. |
| 5,527,658 | A | 6/1996 | Hopper et al. |
| 5,585,215 | A | 12/1996 | Ong et al. |
| 5,650,255 | A | 7/1997 | Ng et al. |
| 5,650,256 | A | 7/1997 | Veregin et al. |
| 5,723,253 | A | 3/1998 | Higashino et al. |
| 5,744,520 | A | 4/1998 | Kmiecik-Lawrynowicz et al. |
| 5,747,215 | A | 5/1998 | Ong et al. |
| 5,763,133 | A | 6/1998 | Ong et al. |
| 5,766,818 | A | 6/1998 | Smith et al. |
| 5,804,349 | A | 9/1998 | Ong et al. |
| 5,827,633 | A | 10/1998 | Ong et al. |
| 5,840,462 | A | 11/1998 | Foucher et al. |
| 5,853,943 | A | 12/1998 | Cheng et al. |
| 5,853,944 | A | 12/1998 | Foucher et al. |
| 5,863,698 | A | 1/1999 | Patel et al. |
| 5,869,215 | A | 2/1999 | Ong et al. |
| 5,902,710 | A | 5/1999 | Ong et al. |
| 5,910,387 | A | 6/1999 | Mychajlowskij et al. |
| 5,916,725 | A | 6/1999 | Patel et al. |
| 5,919,595 | A | 7/1999 | Mychajlowskij et al. |
| 5,922,501 | A | 7/1999 | Cheng et al. |

(Continued)

FOREIGN PATENT DOCUMENTS

| | | |
|---|---|---|
| GB | 1 442 835 | 7/1976 |

*Primary Examiner* — Jonathan Jelsma
(74) *Attorney, Agent, or Firm* — Oliff & Berridge, PLC

(57) ABSTRACT

A method of making toner particles, including mixing at least one emulsion of at least one resin, a colorant, an optional wax, and optional additives to form a slurry; heating the slurry to form aggregated particles in the slurry; freezing aggregation of the particles with a buffer solution; and heating the aggregated particles in the slurry to coalesce the particles into toner particles.

10 Claims, 3 Drawing Sheets

U.S. PATENT DOCUMENTS 5,925,488 A 7/1999 Patel et al.
5,928,829 A 7/1999 Cheng et al.
5,977,210 A 11/1999 Patel et al.
6,063,827 A 5/2000 Sacripante et al.
6,495,302 B1 * 12/2002 Jiang et al. ..... 430/137.14
6,576,389 B2 6/2003 Vanbesien et al.
6,593,049 B1 7/2003 Veregin et al.
6,617,092 B1 9/2003 Patel et al.
6,627,373 B1 9/2003 Patel et al.
6,638,677 B2 10/2003 Patel et al.
6,656,657 B2 12/2003 Patel et al.
6,656,658 B2 12/2003 Patel et al.
6,664,017 B1 12/2003 Patel et al.
6,673,505 B2 1/2004 Jiang et al.
6,756,176 B2 6/2004 Stegamat et al.
6,830,860 B2 12/2004 Sacripante et al.
2006/0063086 A1 * 3/2006 Sacripante et al. ..... 430/109.4
2006/0222991 A1 10/2006 Sacripante et al.
2008/0063958 A1 * 3/2008 Koga et al. ..... 430/48
2008/0199797 A1 8/2008 Sacripante et al.
2008/0236446 A1 * 10/2008 Zhou et al. ..... 106/31.25
2009/0011356 A1 * 1/2009 Tomita et al. ..... 430/109.4
2010/0248118 A1 * 9/2010 Gong et al. ..... 430/108.2

* cited by examiner

METHOD FOR CONTROLLING A TONER PREPARATION PROCESS

TECHNICAL FIELD

This disclosure is generally directed to a method for optimizing the properties of a chemical toner, such as an emulsion aggregation toner, by controlling the toner process parameters, such as pH. More specifically, this disclosure is directed to controlling the process pH-temperature profile through use of a buffer during the freeze step and increasing the toner particle stability during the ramp up to coalescence (without further adjustments) in an emulsion aggregation toner process.

BACKGROUND

In a typical emulsion aggregation toner process, the toner particles' are grown in the slurry and "frozen" at the end of the emulsion aggregation phase. This is done by adjusting the toner slurry pH to a desired pH range, such as around 7-8, by adding, for example, a sodium hydroxide solution (NaOH), with or without a chelating agent, such as ethylene diamine tetraacetic acid (EDTA). Like most strong bases, the NaOH solution has a pH of about 14, if added too quickly, the NaOH solution can shock the toner slurry system when it is used to freeze the slurry. This shock affects the final dry toner properties, thus resulting in print, image, or other such unacceptable defects.

After the emulsion aggregation step, the temperature of the slurry is increased to promote toner coalescence. During this temperature ramp in the coalescence step, the pH of the slurry can become unstable. Thus, the slurry pH must be continuously and carefully monitored and adjusted with periodic amounts of NaOH to maintain the appropriate and specifically desired pH-temperature profile and to prevent further undesired particle growth or particle agglomeration. Any error in NaOH solution addition, such as changes in solution flow rate to the slurry or a pH meter reading malfunction can lead to a batch failure. These errors have increasing probability of occurrence with increasing scale as manufacturing is highly automated; thus potentially increasing the number of failed batches.

In some toner processes, such as those used for making polyester toners, there is a very narrow process latitude. Thus, the above-described problems are particularly difficult to avoid in such processes.

As a result, there exists a need to create pH-temperature stability during the temperature ramp from freezing to the coalescence step to improve process robustness, in particular during temperature ramps, and to ensure that toner particles do not grow out of control and maintain their desired specifications.

SUMMARY

The present disclosure in embodiments addresses these various needs and problems by providing a buffer solution during the freezing process to provide a more stable pH-temperature profile that maintains the final particle size and narrow GSD without further pH adjustments during the temperature ramp to coalescence. Such a process results in a more reliable manufacturing process with less opportunity for operator error and less of a need for operator intervention.

In embodiments, the present disclosure provides a method of making toner particles, comprising:

mixing an emulsion of a resin or combinations of resins, a colorant, an optional wax, and optional additives to form a slurry;

heating the slurry to form aggregated particles in the slurry;

freezing aggregation of the particles with a buffer solution having a pH of about 7 to about 12; and heating the aggregated particles and slurry to coalesce the aggregated particles into toner particles.

In embodiments, the freezing step provides a method for making toner particles where no further pH adjustment is necessary during the temperature ramp to coalesce the particles.

These and other improvements are accomplished by the methods described in embodiments herein.

EMBODIMENTS

Figure 1:
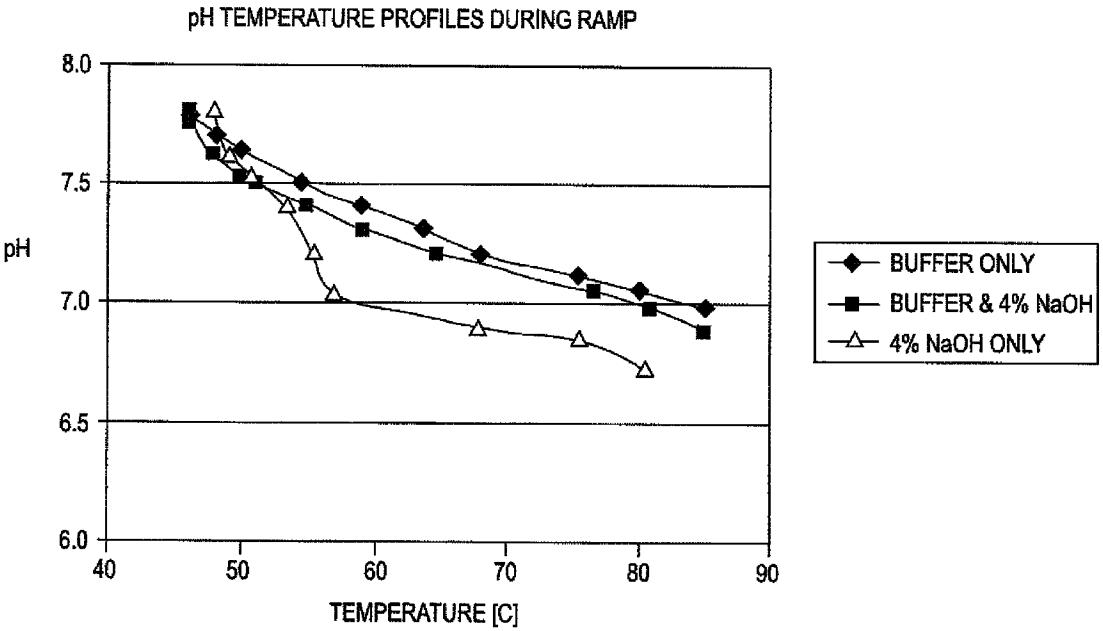
FIG. 1 illustrates exemplary pH and temperature profiles during the temperature ramp to coalescence.

The present disclosure provides modified emulsion aggregation and coalescence processes having better pH and temperature control in the coalescence step. The modified process for making toner particles generally includes mixing a resin emulsion, a colorant, an optional wax, and optional additives to form a slurry; heating the slurry to form aggregated particles in the slurry; freezing aggregation of the particles with a buffer solution; and heating the aggregated particles and slurry to coalesce the aggregated particles into toner particles. In embodiments, the freezing step provides a method for making toner particles where no further pH adjustment is necessary during the temperature ramp to coalesce the particles.

Resins and Polymers

In embodiments, the process may be used to make various toners, for example, styrene acrylate toners, UV curable toners, and polyester toners.

Styrene resins and polymers are known in the art. In embodiments, specific styrene resins may be, for example, styrene-based monomers, including styrene acrylate-based monomers. Illustrative examples of such resins may be found, for example, in U.S. Pat. Nos. 5,853,943, 5,922,501, 5,928,829, the entire disclosures thereof being incorporated herein by reference.

Specific examples that may be utilized include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly(styrene-butyl acrylate), poly(styrene-butadiene-acrylic acid), poly(styrene-butadiene-methacrylic acid), poly(styrene-butadiene-acrylonitrile-acrylic acid), poly(styrene-butyl acrylate-acrylic acid), polystyrene-butyl acrylate-methacrylic acid), poly(styrene-butyl acrylate-acrylonitrile), and poly(styrene-butyl acrylate-acrylonitrile-acrylic acid), and combinations thereof. The polymer may be block, random, or alternating copolymers.

UV curable resins are known in the art. In embodiments, UV curable resins may be unsaturated polymers that can be crosslinked in the presence of activating radiation such as ultraviolet light and a suitable photo initiator. Illustrative examples of such resins may be found, for example, in U.S. Patent Application Publication No. 2008-0199797, the entire disclosure thereof being incorporated herein by reference.

Polyester resins are also known in the art. The specific polyester resin or resins selected for the present disclosure include, for example, unsaturated polyester and/or its derivatives, polyimide resins, branched polyimide resins, and any of the various polyesters, such as crystalline polyesters, amorphous polyesters, or a mixture thereof. Thus, for example, the toner particles can be comprised of crystalline polyester resins, amorphous polyester resins, or a mixture of two or more polyester resins where one or more polyester is crystalline and one or more polyester is amorphous. Illustrative examples of such resins may be found, for example, in U.S. Pat. Nos. 6,593,049, 6,756,176, and 6,830,860, the entire disclosures thereof being incorporated herein by reference.

The resin may be a polyester resin formed by reacting a diol with a diacid in the presence of acatalyst. For forming a crystalline polyester, suitable organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, ethylene glycol, combinations thereof, and the like. The aliphatic diol may be, for example, selected in an amount of from about 40 to about 60 mole percent, in embodiments from about 42 to about 55 mole percent, in embodiments from about 45 to about 53 mole percent of the resin.

Examples of organic diacids or diesters selected for the preparation of the crystalline resins include oxalic acid, succinic acid, glutaric acid, adipic acid, suberic acid, azelaic acid, fumaric acid, maleic acid, dodecanedioic acid, sebacic acid, phthalic acid, isophthalic acid, terephthalic acid, naphthalene-2,6-dicarboxylic acid, naphthalene-2,7-dicarboxylic acid, cyclohexane dicarboxylic acid, malonic acid and mesaconic acid, a diester or anhydride thereof, and combinations thereof. The organic diacid may be selected in an amount of, for example, in embodiments from about 40 to about 60 mole percent, in embodiments from about 42 to about 55 mole percent, in embodiments from about 45 to about 53 mole percent.

Examples of crystalline resins include polyesters, polyamides, polyimides, polyolefins, polyethylene, polybutylene, polyisobutyrate, ethylene-propylene copolymers, ethylene-vinyl acetate copolymers, polypropylene, mixtures thereof, and the like. Specific crystalline resins may be polyester based, such as poly(ethylene-adipate), poly(propylene-adipate), polybutylene-adipate), poly(pentylene-adipate), poly (hexylene-adipate), poly(octylene-adipate), polyethylene-succinate), polypropylene-succinate), polybutylene-succinate), poly(pentylene-succinate), poly(hexylene-succinate), poly(octylene-succinate), poly(ethylene-sebacate), poly(propylene-sebacate), poly(butylene-sebacate), poly(pentylene-sebacate), poly(hexylene-sebacate), poly(octylene-sebacate), alkali copoly(5-sulfoisophthaloyl)-copoly(ethylene-adipate), poly(decylene-sebacate), pol(decylene-decanoate), poly-(ethylene-decanoate), poly-(ethylene-dodecanoate), poyl(nonylene-sebacate), poly (nonylene-decanoate), copoly(ethylene-fumarate)-copyly)-(ethylene-sebacate), copoly(ethylene-fumarate)-copyly)-(ethylene-decanoate), and copoly (ethylene-fumarate)-copyly)-(ethylene-dodecanoate), and combinations thereof.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 2 to about 6, in embodiments from about 3 to about 4.

Examples of diacid or diesters selected for the preparation of amorphous polyesters include dicarboxylic acids or diesters such as terephthalic acid, phthalic acid, isophthalic acid, fumaric acid, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecanediacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 55 mole percent of the resin, in embodiments from about 45 to about 53 mole percent of the resin.

Examples of diols utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized for either the crystalline or amorphous polyesters include tetraalkyl titanates such as titanium (iv) butoxide or titanium (iv) iso-propoxide, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.001 mole percent to about 0.55 mole percent based on the starting diacid or diester used to generate the polyester resin.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include poly(styrene-acrylate) resins, crosslinked, for example, from about 10 percent to about 70 percent, poly(styrene-acrylate) resins, poly(styrene-methacrylate) resins, crosslinked poly(styrene-methacrylate) resins, poly(styrene-butadiene) resins, crosslinked poly(styrene-butadiene) resins, alkali sulfonated-polyester resins, branched alkali sulfonated-polyester resins, alkali sulfonated-polyimide resins, branched alkali sulfonated-polyimide resins, alkali sulfonated poly(styrene-acrylate) resins, crosslinked alkali sulfonated polystyrene-acrylate) resins, poly(styrene-methacrylate) resins, crosslinked alkali sulfonated-poly(styrene-methacrylate) resins, alkali sulfonated-poly(styrene-butadiene) resins, and crosslinked alkali sulfonated poly(styrene-butadiene) resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfoisophthalate), copoly(propylene-butylene-terephthalate)-copoly(propylene-butylene-5-sulfo-isophthalate), and copoly(propoxylated bisphenol-A-fumarate)-copoly(propoxylated bisphenol A-5-sulfo-isophthalate).

Examples of other suitable latex resins or polymers which may be utilized include, but are not limited to, poly(styrene-butadiene), poly(methylstyrene-butadiene), poly(methyl methacrylate-butadiene), poly(ethyl methacrylate-butadiene), poly(propyl methacrylate-butadiene), poly(butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene); poly(styrene-propyl acrylate), poly(styrene-butyl acrylate), polystyrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylonitrile), and poly(styrene-butyl acrylate-acrylonitrile-acrylic acid), and combinations thereof. The polymers may be block, random, or alternating copolymers.

In embodiments, an unsaturated polyester resin may be utilized as a latex resin. Examples of such resins include those disclosed in U.S. Pat. No. 6,063,827, the disclosure of which is hereby incorporated by reference in its entirety. Exemplary unsaturated polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable amorphous polyester resin may be a poly(propoxylated bisphenol A co-fumarate) resin having the following formula (I):

(I)

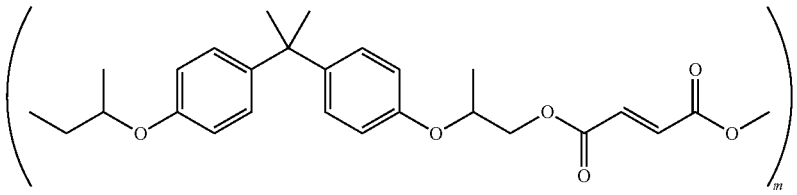

wherein m may be from about 5 to about 1000.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C. and the like.

Suitable crystalline resins include those disclosed in U.S. Patent Application Publication No. 2006/0222991, the disclosure of which is hereby incorporated by reference in its entirety. In embodiments, a suitable crystalline resin may be composed of ethylene glycol and a mixture of dodecanedioic acid and fumaric acid co-monomers with the following formula:

(II)

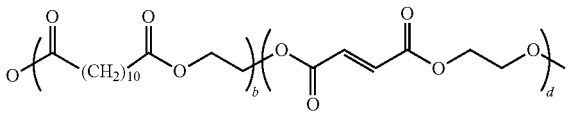

wherein b is from about 5 to about 2000 and d is from about 5 to about 2000.

One, two, or more toner resins/polymers may be used. In embodiments where two or more toner resins are used, the toner resins may be in any suitable ratio (e.g., weight ratio) such as for instance about 10% first resin: 90% second resin to about 90% first resin: 10% second resin. In embodiments, the amorphous resin utilized in the core may be linear.

In embodiments, the resin may be formed by emulsion polymerization methods. In other embodiments, a pre-made resin may be utilized to form the toner.

Surfactants

In embodiments, colorants, waxes, and other additives utilized to form toner compositions may be in dispersions including surfactants. Moreover, toner particles may be formed by emulsion aggregation methods where the resin and other components of the toner are placed in contact with one or more surfactants, an emulsion is formed, toner particles are aggregated, coalesced, optionally washed and dried, and recovered.

One, two, or more surfactants may be utilized. The surfactants may be selected from ionic surfactants and nonionic surfactants. Anionic surfactants and cationic surfactants are encompassed by the term "ionic surfactants." In embodiments, the surfactant may be utilized so that it is present in an amount of from about 0.01% to about 5% by weight of the toner composition, from about 0.75% to about 4% by weight of the toner composition, or from about 1% to about 3% by weight of the toner composition.

Examples of nonionic surfactants that can be utilized include, for example, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxy poly(ethyleneoxy) ethanol, available from Rhone-Poulenac as IGEPAL CA210™, IGEPAL CA-520™, IGEPAL CA-720™, IGEPAL CO-890™, IGEPAL CO-720™, IGEPAL CO-290™, IGEPAL CA-210™, ANTAROX890™ and ANTAROX 897™. Other examples of suitable nonionic surfactants include a block copolymer of polyethylene oxide and polypropylene oxide, including those commercially available as SYNPERONIC PE/F, in embodiments SYNPERONIC PE/F 108.

Anionic surfactants which may be utilized include sulfates and sultanates, sodium dodecylsulfate (SDS), sodium dodecylbenzene sulfonate, sodium dodecylnaphthalene sulfate, dialkyl benzenealkyl sulfates and sulfonates, acids such as abitic acid available from Aldrich, NEOGEN R™, NEOGEN SC™ obtained from Daiichi Kogyo Seiyaku, combinations thereof, and the like. Other suitable anionic surfactants include, in embodiments, DOWFAX™ 2A1, an alkyldiphenyloxide disulfonate from The Dow Chemical Company, and/or TAYCA POWER BN2060 from Tayca Corporation (Japan), which are branched sodium dodecyl benzene sulfonates. Combinations of these surfactants and any of the foregoing anionic surfactants may be utilized in embodiments.

Examples of the cationic surfactants, which are usually positively charged, include, for example, alkylbenzyl dimethyl ammonium chloride, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$, $C_{17}$ trimethyl ammonium bromides, halide salts of quaternized polyoxyethylalkylamines, dodecylbenzyl triethyl ammonium chloride, MIRAPOL™ and ALKAQUAT™, available from Alkaril Chemical Company, SANIZOL™ (benzalkonium chloride), available from Kao Chemicals, and the like, and mixtures thereof.

Waxes

In embodiments, the resin emulsion can be prepared to also include wax therein. In these embodiments, the emulsion will include resin and wax particles at the desired loading levels, which allows for a single resin and wax emulsion to be made rather than separate resin and wax emulsions. Further, in these embodiments, the combined emulsion allows for reduction in the amount of surfactant needed to prepare separate emulsions for incorporation into toner compositions. This is particularly helpful in instances where it would otherwise be difficult to incorporate the wax into the emulsion. However, in embodiments, the wax can also be separately emulsified, such as with a resin, and separately incorporated into final products.

In addition to the polymer binder resin, the toners of the present disclosure also contain a wax, either a single type of wax or a mixture of two or more preferably different waxes. A single wax can be added to toner formulations, for example, to improve particular toner properties, such as toner particle shape, presence and amount of wax on the toner particle surface, charging and/or fusing characteristics, gloss, stripping, offset properties, and the like. Alternatively, a combination of waxes can be added to provide multiple properties to the toner composition.

Suitable examples of waxes include waxes selected from natural vegetable waxes, natural animal waxes, mineral waxes, synthetic waxes and functionalized waxes. Examples of natural vegetable waxes include, for example, carnauba wax, candelilla wax, rice wax, sumacs wax, jojoba oil, Japan wax, and bayberry wax. Examples of natural animal waxes include, for example, beeswax, Punic wax, lanolin, lac wax, shellac wax, and spermaceti wax. Mineral-based waxes include, for example, paraffin wax, microcrystalline wax, montan wax, ozokerite wax, ceresin wax, petrolatum wax, and petroleum wax. Synthetic waxes include, for example, Fischer-Tropsch wax; acrylate wax; fatty acid amide wax; silicone wax; polytetrafluoroethylene wax; polyethylene wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate; and cholesterol higher fatty acid ester waxes, such as cholesteryl stearate; polypropylene wax; and mixtures thereof.

Examples of waxes of embodiments include polypropylenes and polyethylenes commercially available from Allied Chemical and Baker Petrolite (for example POLYWAX™ polyethylene waxes from Baker Petrolite), wax emulsions available from Michelman Inc. and the Daniels Products Company, EPOLENE N-15 commercially available from Eastman Chemical Products, Inc., VISCOL 550-P, a low weight average molecular weight polypropylene available from Sanyo Kasei K.K., and similar materials. The commercially available polyethylenes usually possess a molecular weight Mw of from about 500 to about 2,000, such as from about 1,000 to about 1,500, while the commercially available polypropylenes utilized have a molecular weight of about 1,000 to about 10,000. Examples of functionalized waxes include amines, amides, imides, esters, quaternary amines, carboxylic acids or acrylic polymer emulsion, for example, JONCRYL 74, 89, 130, 537, and 538, all available from Johnson Diversey, Inc., chlorinated polypropylenes and polyethylenes commercially available from Allied Chemical and Petrolite Corporation and Johnson Diversey, Inc. Many of the polyethylene and polypropylene compositions useful in embodiments are illustrated in British Pat. No. 1,442,835, the entire disclosure of which is incorporated herein by reference.

The toners may contain the wax in any amount of from, for example, about 1 to about 25 percent by weight of toner, such as from about 3 to about 15 percent by weight of the toner, on a dry basis; or from about 5 to about 20 percent by weight of the toner, such as from about 5 to about 11 percent weight of the toner.

Colorants

In embodiments, the toners may also contain at least one colorant. For example, colorants or pigments as used herein include pigment, dye, mixtures of pigment and dye, mixtures of pigments, mixtures of dyes, and the like. For simplicity, the term "colorant" as used herein is meant to encompass such colorants, dyes, pigments, and mixtures, unless specified as a particular pigment or other colorant component. In embodiments, the colorant comprises a pigment, a dye, mixtures thereof, carbon black, magnetite, black, cyan, magenta, yellow, red, green, blue, brown, mixtures thereof, in an amount of about 0.1 percent to about 35 percent by weight based upon the total weight of the composition, such as from about 1 to about 25 percent by weight. It is to be understood that other useful colorants will become readily apparent based on the present disclosures.

In general, useful colorants include Paliogen Violet 5100 and 5890 (BASF), Normandy Magenta RD-2400 (Paul Uhlrich), Permanent Violet VT2645 (Paul Uhlrich), Heliogen Green L8730 (BASF), Argyle Green XP-111-S (Paul Uhlrich), Brilliant Green Toner GR 0991 (Paul Uhlrich), Lithol Scarlet D3700 (BASF), Toluidine Red (Aldrich), Scarlet for Thermoplast NSD Red (Aldrich), Lithol Rubine Toner (Paul Uhlrich), Lithol Scarlet 4440, NBD 3700 (BASF), Bon Red C (Dominion Color), Royal Brilliant Red RD-8192 (Paul Uhlrich), Oracet Pink RF (Ciba Geigy), Paliogen Red 3340 and 3871K (BASF), Lithol Fast Scarlet L4300 (BASF), Heliogen Blue D6840, D7080, K7090, K6910 and L7020 (BASF), Sudan Blue OS (BASF), Neopen Blue FF4012 (BASF), PV Fast Blue B2G01 (American Hoechst), Irgalite Blue BCA (Ciba Geigy), Paliogen Blue 6470 (BASF), Sudan II, III and IV (Matheson, Coleman, Bell), Sudan Orange (Aldrich), Sudan Orange 220 (BASF), Paliogen Orange 3040 (BASF), Ortho Orange OR 2673 (Paul Uhlrich), Paliogen Yellow 152 and 1560 (BASF), Lithol Fast Yellow 0991K (BASE), Paliotol Yellow 1840 (BASF), Novaperm Yellow FGL (Hoechst), Permanent Yellow YE 0305 (Paul Uhlrich), Lumogen Yellow D0790 (BASF), Suco-Gelb 1250 (BASF), Suco-Yellow D1355 (BASF), Suco Fast Yellow D1165, D1355 and D1351 (BASF), Hostaperm Pink E (Hoechst), Fanal Pink D4830 (BASF), Cinquasia Magenta (DuPont), Paliogen Black L9984 9BASF), Pigment Black K801 (BASF) and particularly carbon blacks such as REGAL 330 (Cabot), Carbon Black 5250 and 5750 (Columbian Chemicals), and the like or mixtures thereof Additional useful colorants include pigments in water based dispersions such as those commercially available from Sun Chemical, for example SUNSPERSE BHD 6011X (Blue 15 Type), SUNSPERSE BHD 9312X (Pigment Blue 15 74160), SUNSPERSE BHD 6000X (Pigment Blue 15:3 74160), SUNSPERSE GHD 9600X and GHD 6004X (Pigment Green 7 74260), SUNSPERSE QHD 6040X (Pigment Red 122 73915), SUNSPERSE RHD 9668X (Pigment Red 185 12516), SUNSPERSE RHD 9365X and 9504X (Pigment Red 57 15850:1, SUNSPERSE YHD 6005X (Pigment Yellow 83 21108), FLEXIVERSE YFD 4249 (Pigment Yellow 17 21105), SUNSPERSE YHD 6020X and 6045X (Pigment Yellow 74 11741), SUNSPERSE YHD 600X and 9604X (Pigment Yellow 14 21095), FLEXIVERSE LED 4343 and LFD 9736 (Pigment Black 7 77226) and the like or mixtures thereof. Other useful water based colorant dispersions include those commercially available from Clariant, for example, HOSTAFINE Yellow GR, HOSTAFINE Black T and Black TS, HOSTAFINE Blue B2G, HOSTAFINE Rubine F6B and magenta dry pigment such as Toner Magenta 6BVP2213 and Toner Magenta EO2 which can be dispersed in water and/or surfactant prior to use.

Other useful colorants include, for example, magnetites, such as Mobay magnetites MO8029, MO8960; Columbian magnetites, MAPICO BLACKS and surface treated magnetites; Pfizer magnetites CB4799, CB5300, CB5600, MCX6369; Bayer magnetites, BAYFERROX 8600, 8610; Northern Pigments magnetites, NP-604, NP-608; Magnox magnetites TMB-100 or TMB-104; and the like or mixtures thereof. Specific additional examples of pigments include phthalocyanine HELIOGEN BLUE L6900, D6840, D7080, D7020, PYLAM OIL BLUE, PYLAM OIL YELLOW, PIGMENT BLUE 1 available from Paul Uhlrich & Company, Inc., PIGMENT VIOLET 1, PIGMENT RED 48, LEMON CHROME YELLOW DCC 1026, E.D. TOLUIDINE RED and BON RED C available from Dominion Color Corporation, Ltd., Toronto, Ontario, NOVAPERM YELLOW FGL, HOSTAPERM PINK E from Hoechst, and CINQUASIA MAGENTA available from E.I. DuPont de Nemours & Company, and the like. Examples of magentas include, for example, 2,9-dimethyl substituted quinacridone and anthraquinone dye identified in the Color Index as CI-60710, CI Dispersed Red 15, diazo dye identified in the Color Index as CI-26050, CI Solvent Red 19, and the like or mixtures thereof. Illustrative examples of cyans include copper tetra (octadecyl sulfonamide) phthalocyanine, x-copper phthalocyanine pigment listed in the Color Index as CI74160, CI Pigment Blue, and Anthrathrene Blue identified in the Color Index as DI 69810, Special Blue X-2137, and the like or mixtures thereof. Illustrative examples of yellows that may be selected include diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,4-dimethoxy acetoacetanilide, and Permanent Yellow FGL. Colored magnetites, such as mixtures of MAPICOBLACK and cyan components may also be selected as pigments.

The colorant, such as carbon black, cyan, magenta and/or yellow colorant, is incorporated in an amount sufficient to impart the desired color to the toner. In general, pigment or dye is employed in an amount ranging from about 1 to about 35 percent by weight of the toner particles on a solids basis, such as from about 5 to about 25 percent by weight or from about 5 to about 15 percent by weight. However, amounts outside these ranges can also be used, in embodiments.

Coagulants

The emulsion aggregation process for making toners of the present disclosure uses at least a coagulant, such as a monovalent metal coagulant, a divalent metal coagulant, a polyion coagulant, or the like. A variety of coagulants are known in the art, as described above. As used herein, "polyion coagulant" refers to a coagulant that is a salt or oxide, such as a metal salt or metal oxide, formed from a metal species having a valence of at least 3, and desirably at least 4 or 5. Suitable coagulants thus include, for example, coagulants based on aluminum such as polyaluminum halides such as polyaluminum fluoride and polyaluminum chloride (PAC), polyaluminum silicates such as polyaluminum sulfosilicate (PASS), polyaluminum hydroxide, polyaluminum phosphate, aluminum sulfate, and the like. Other suitable coagulants include, but are not limited to, tetraalkyl titinates, dialkyltin oxide, tetraalkyltin oxide hydroxide, dialkyltin oxide hydroxide, aluminum alkoxides, alkylzinc, dialkyl zinc, zinc oxides, stannous oxide, dibutyltin oxide, dibutyltin oxide hydroxide, tetraalkyl tin, and the like. Where the coagulant is a polyion coagulant, the coagulants may have any desired number of polyion atoms present. For example, suitable polyaluminum compounds in embodiments have from about 2 to about 13, such as from about 3 to about 8, aluminum ions present in the compound Such coagulants can be incorporated into the toner particles during particle aggregation. As such, the coagulant can be present in the toner particles, exclusive of external additives and on a dry weight basis, in amounts of from 0 to about 5 percent by weight of the toner particles, such as from about greater than 0 to about 3 percent by weight of the toner particles.

Buffer Solution

In embodiments, a buffer solution is used to ensure pH stability during the temperature ramp to coalescence and to eliminate pH shock to the system, thus avoiding irregularities or toner particles that are out of the desired specifications. The buffer may be selected from any suitable buffer capable of ensuring pH stability during the temperature ramp to coalescence.

In embodiments, the buffer system may include at least two of acids, salts, bases, organic compounds, and combinations thereof in a solution with deionized water as the solvent.

Suitable acids which may be utilized to form the buffer system include, but are not limited to, organic and/or inorganic acids such as acetic acid, citric acid, hydrochloric acid, boric acid, formic acid, oxalic acid, phthalic acid, salicylic acid, combinations thereof, and the like.

Suitable salts or bases which may be utilized to form the buffer system include, but are not limited to, metallic salts of aliphatic acids or aromatic acids and bases, such as sodium hydroxide (NaOH), sodium tetraborate, potassium acetate, zinc acetate, sodium dihydrogen phosphate, disodium hydrogen phosphate, potassium formate, potassium hydroxide, sodium oxalate, sodium phthalate, potassium salicylate, combinations thereof, and the like.

Suitable organic compounds which may be utilized to form the buffer system include, but are not limited to, tris(hydroxymethyl)aminomethane ("TRIS"), Tricine, Bicine, Glycine, HEPES, Trietholamine hydrochloride, MOPS, combinations thereof, and the like.

In embodiments, a suitable buffer system may include a combination of acids and organic compounds. For example, a buffer system may include TRIS and hydrochloric acid.

The amount of acid and organic compound utilized in forming the buffer system, as well as deionized water utilized in forming a buffer solution, may vary depending upon the acid used, the organic compound used, and the composition of the toner particles. As noted above, a buffer system may include both an acid and an organic compound. In such a case, the amount of acid in the buffer system may be from about 1% to about 40% by weight of the buffer system, such as from about 2% to about 30% by weight. The amount of organic compound in the buffer system may be from about 10% to about 50% by weight of the buffer system, such as from about 30% to about 40% by weight of the buffer system.

The amount of acid and/or organic compound in the buffer system may be in amounts so that the pH of the buffer system is from about 7 to about 12, such as from about 7 to about 9, from about 8 to about 9, or about 9.

The buffer system may be added to the toner slurry as described above so that the pH of the final toner slurry is from about 6 to about 9, such as from about 7 to about 8.

Emulsion Aggregation Procedures

Any suitable emulsion aggregation procedure may be used and modified in forming the emulsion aggregation toner particles without restriction. These procedures typically include the basic process steps of at least aggregating an emulsion containing polymer binder, optionally one or more waxes, one or more colorants, one or more surfactants, an optional coagulant, and one or more additional optional additives to form aggregates, subsequently freezing particle aggregates, and coalescing or fusing the aggregates, and then recovering, optionally washing and optionally drying the obtained emulsion aggregation toner particles.

In embodiments, the pH is adjusted in a freezing step by using a buffer system as described above. Once the targeted particle size is reached during aggregation, the aggregation step is frozen. This is done by adjusting the pH using the above buffer solution. More specifically, the pH of the slurry is initially adjusted to a pH of about 3.5 to about 6, such as from about 4.5 to about 5.5 by adding the buffer solution with a pH of about 9. Next, this adjustment is quickly followed by the addition of EDTA/water and the pH of the slurry is further adjusted to about 6 to about 9, such as from about 7 to about 8 using the pH 9 buffer either alone or in combination with an NaOH solution.

The process proceeds to coalescence by increasing the reactor's temperature to the coalescence temperature. The presence of the buffer solution allows the coalescence to proceed without any further pH adjustments. Thus, in embodiments, it is not necessary to periodically add additional solution, such as NaOH solution, to maintain a desired pH-temperature profile.

Once at the coalescence temperature, the toner slurry pH is adjusted to a more acidic range to achieve the target particle circularity. The coalesced particles can be measured for circularity, such as with a Sysmex FPIA 2100 analyzer, until the desired shape is achieved.

After coalescence, the mixture may be cooled to room temperature, such as from about 20° C. to about 25° C. The cooling may be rapid or slow, as desired. A suitable cooling method may include introducing cold water to a jacket around the reactor or a heat exchanger to quench. After cooling, the toner particles may be optionally washed with water, and then dried. Drying may be accomplished by any suitable method for drying including, for example, freeze-drying.

It is also desirable to control the toner particle size and limit the amount of both fine and coarse toner particles in the toner. In an embodiment, the toner particles have a very narrow particle size distribution with a lower number ratio geometric standard deviation (GSD) of about 1.15 to about 1.30, or about less than 1.25. The toner particles of the present disclosure also can have a size such that the upper geometric standard deviation (GSD) by volume is in the range of from about 1.15 to about 1.30, such as from about 1.18 to about 1.22, or less than about 1.25. These GSD values for the toner particles of the present disclosure indicate that the toner particles are made to have a very narrow particle size distribution.

Circularity is also a control process parameter associated with the toner being able to achieve optimal machine performance. The instrument used is an FPIA-2100 manufactured by Sysmex. For a completely circular sphere the circularity would be 1.000. The toner particles can have circularity of about 0.920 to about 0.990 and, such as from about 0.940 to about 0.980, or greater than or equal to about 0.965.

Suitable emulsion aggregation/coalescing processes for the preparation of toners, and which can be modified to include the freezing process as described herein, are illustrated in a number of Xerox patents, the disclosures of each of which are totally incorporated herein by reference, such as U.S. Pat. Nos. 5,290,654, 5,278,020, 5,308,734, 5,370,963, 5,344,738, 5,403,693, 5,418,108, 5,364,729, and 5,346,797.

Also of interest are U.S. Pat. Nos. 5,348,832; 5,405,728; 5,366,841; 5,496,676; 5,527,658; 5,585,215; 5,650,255; 5,650,256; 5,501,935; 5,723,253; 5,744,520; 5,763,133; 5,766,818; 5,747,215; 5,827,633; 5,853,944; 5,804,349; 5,840,462; 5,869,215; 5,863,698; 5,902,710; 5,910,387; 5,916,725; 5,919,595; 5,925,488; and 5,977,210, the disclosures of each of which are hereby totally incorporated herein by reference. In addition, Xerox U.S. Pat. Nos. 6,627,373; 6,656,657; 6,617,092; 6,638,677; 6,576,389; 6,664,017; 6,656,658; and 6,673,505 are each hereby totally incorporated herein by reference. The appropriate components and process aspects of each of the foregoing U.S. patents may be selected for the present composition and process in embodiments thereof.

EXAMPLES

Three examples are given below for a cyan toner in which one is made with only pH 9 TRIS with hydrochloric acid (TRIS-HCl) buffer solution, another is made with a combination of buffer and separate addition of 4% NaOH and the other, control toner is made with only the addition of 4% NaOH solution to freeze the toner particles.

Example 1

5.8 μm Cyan Toner with pH 9 Buffer Solution

A cyan polyester toner was prepared at the 2 L Bench scale (150 g dry theoretical toner). Two amorphous emulsions comprising terpoly-(propoxylated bisphenol A-fumarate)-terpoly (propoxylated bisphenol A-terephthalate)-terpoly-(propoxylated bisphenol A-2-dodecylsuccinate) as a resin and Dowfax as a surfactant, a crystalline emulsion comprising poly (nonane-dodecanoiate) as a resin and DOWFAX as a surfactant, additional surfactant (DOWFAX), a wax (IGI wax, available as "D1509" from The International Group, Inc.), and a pigment (Cyan 15:3 Dispersion) were mixed to form a slurry; then the pH of the slurry was adjusted to 4.2 using 0.3M nitric acid. The slurry was then homogenized for a total of 5 minutes at 3000-4000 rpm while adding in the coagulant, aluminum sulphate. The toner slurry was then transferred to the 2 L Buchi and aggregated at a batch temperature of 44° C. Once the toner particle size reached ~4.6 μm, a shell comprised of the same amorphous emulsions in the core was then added.

Once at the targeted particle size (~5.5 μm), the aggregation step was frozen. The freeze step began with a pH adjustment using 10.2 g of pH9 TRIS-HCl buffer to about pH 4.5, quickly followed by the addition of EDTA/water and a further pH adjustment using 34 g of pH9 TRIS-HCl buffer to reach pH 7.8. The process proceeded with the reactor temperature (Tr) being increased to achieve 85° C. with NO further pH adjustments, where the particles began to coalesce. During the ramp up, pH was measured regularly. Table 1 displays the temperature profile along with the pH as the temperature increased to 85° C. As is shown, the pH remains relatively constant throughout the temperature ramp up. Once at 85° C., the toner slurry pH was reduced using pH 5.7 buffer to achieve a particle circularity of ≧0.965 and was then cooled. The final toner particle size/GSDv/GSDn and circularity were 5.77/1.2328/1.2328 and 0.973, respectively.

TABLE 1

| Temperature [° C.] | pH | D50 (mm) | GSDv | GSDn | Circularity | Comments |
|---|---|---|---|---|---|---|
| 46 | 3.12 | 5.48 | 1.2199 | 1.2199 | — | Before freeze |
| 46 | 7.80 | 5.71 | 1.2199 | 1.2328 | — | After freeze |
| 46 | 7.78 | | | | | start ramping temp |
| 48 | 7.70 | | | | | |
| 50 | 7.64 | | | | | |
| 54.5 | 7.50 | | | | | |
| 59 | 7.40 | 5.71 | 1.2328 | 1.2328 | — | |
| 63.8 | 7.30 | | | | | |
| 68 | 7.20 | | | | | |
| 75.5 | 7.11 | | | | 0.909 | |
| 80 | 7.05 | | | | 0.911 | |
| 85 | 6.98 | | | | 0.916 | |
| 85 | 6.05 | 5.77 | 1.2328 | 1.2328 | 0.973 | final particle |

Example 2

5.8 μm Cyan Toner with a Combination of pH9 Buffer and 4% Sodium Hydroxide Solution (NaOH)

The process as outlined in Example 1 was repeated, with the freeze step modified as follows. Once at the targeted particle size (~5.5 μm); the aggregation step was frozen. The freeze step began with a pH adjustment using 11 g of pH9 TRIS-HCl buffer solution to about pH 4.5, quickly followed by the addition of EDTA/water and further pH adjusted using 7.5 g of 4% NaOH solution to reach pH 7.8. The process proceeded with the reactor temperature (Tr) being increased to achieve 85° C. with NO further pH adjustments, where the particles should begin to coalesce. During the ramp up, pH was monitored. Table 2 displays the temperature profile along with the pH as the temperature increased to 85° C. As is shown, the pH remains relatively constant throughout the temperature ramp up. Once at 85° C., the toner slurry pH was reduced using pH 5.7 buffer to achieve a particle circularity of ≧0.965 and was then cooled. The final toner particle size/GSDv/GSDn and circularity were 5.54/1.2328/1.2072 and 0.980, respectively.

TABLE 2

| Temperature [° C.] | pH | D50 (mm) | GSDv | GSDn | Circularity | Comments |
|---|---|---|---|---|---|---|
| 46 | 3.22 | 5.48 | 1.2457 | 1.2199 | — | Before freeze |
| 46 | 7.80 | 5.48 | 1.2100 | 1.2100 | — | After freeze |
| 46 | 7.76 | | | | | start ramping temp |
| 48 | 7.62 | | | | | |
| 50 | 7.54 | | | | | |
| 51 | 7.50 | | | | | |
| 55 | 7.40 | 5.54 | 1.2070 | 1.2199 | — | |
| 59.2 | 7.30 | | | | | |
| 64.7 | 7.20 | | | | | |
| 76.6 | 7.04 | | | | | |
| 81 | 6.98 | | | | | |
| 85 | 6.88 | | | | | |
| 85 | 6.20 | 5.54 | 1.2328 | 1.2072 | 0.980 | final particle |

Example 3

5.8 μm Cyan Toner with Only 4% Sodium Hydroxide Solution (NaOH)

Control Toner

The process as outlined in Example 1 was repeated, with the freeze step modified as follows, Once at the targeted particle size (~5.5 μm); the aggregation step was frozen. The freeze step began with a pH adjustment using 3 g total of 4% NaOH solution to about pH 4.5, quickly followed by the addition of EDTA/water and further pH adjusted using 3.9 g of 4% NaOH solution to reach pH 7.8. The process proceeds with the reactor temperature (Tr) being increased to achieve 85° C. with NO further pH adjustments, where the particles should begin to coalesce. Coalescence was not possible for this toner due to the toner instability during ramp up that caused the toner to grow. The final toner particle size/GSDv/GSDn was 6.75/1.3906/1.3067.

TABLE 3

| Temperature [° C.] | pH | D50(mm) | GSDv | GSDn | Comments |
|---|---|---|---|---|---|
| 48 | 3.15 | 5.54 | 1.2073 | 1.2199 | Before freeze |
| 48 | 7.81 | 5.54 | 1.2010 | 1.2136 | After freeze |
| 48 | 7.72 | | | | start ramping temp |
| 49 | 7.62 | | | | |
| 50 | 7.56 | | | | |
| 50.8 | 7.53 | 5.60 | 1.2072 | 1.2136 | |
| 53.5 | 7.40 | 5.54 | 1.2072 | 1.2263 | |
| 55.4 | 7.21 | 5.60 | 1.2137 | 1.2392 | |
| 57 | 7.03 | 5.60 | 1.2200 | 1.2457 | |
| 67.8 | 6.90 | 6.75 | 1.3906 | 1.3067 | |
| 75.5 | 6.85 | 6.75 | 1.3906 | 1.3067 | |
| 80.5 | 6.72 | | | | began cooling |

Figure 2:
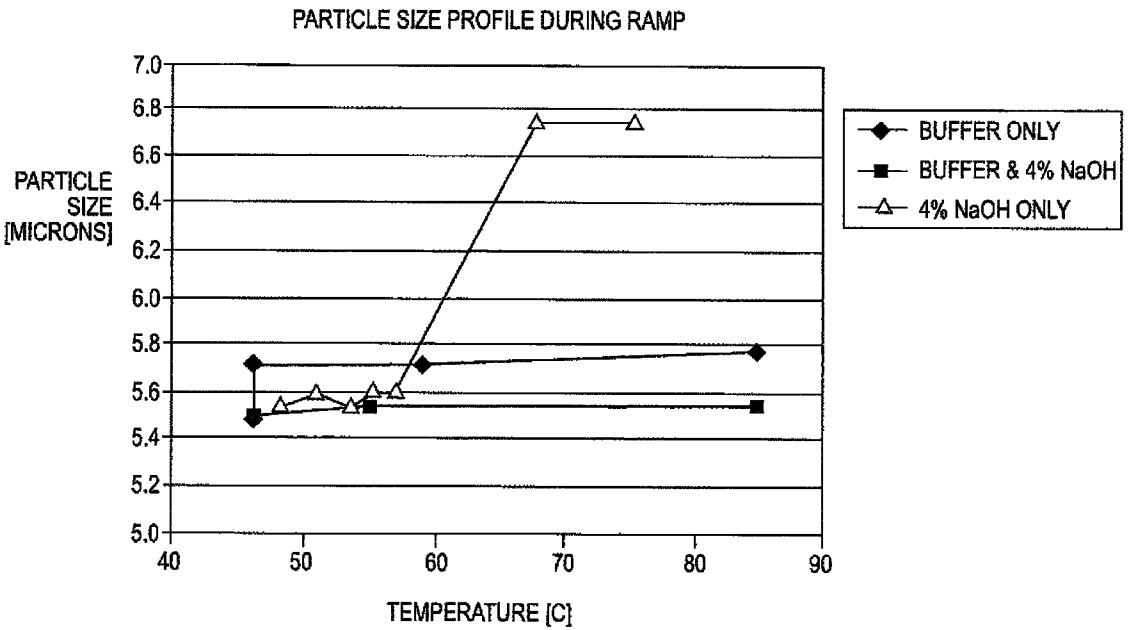
FIG. 2 illustrates exemplary particle size profiles during the temperature ramp to coalescence.
Figure 3:
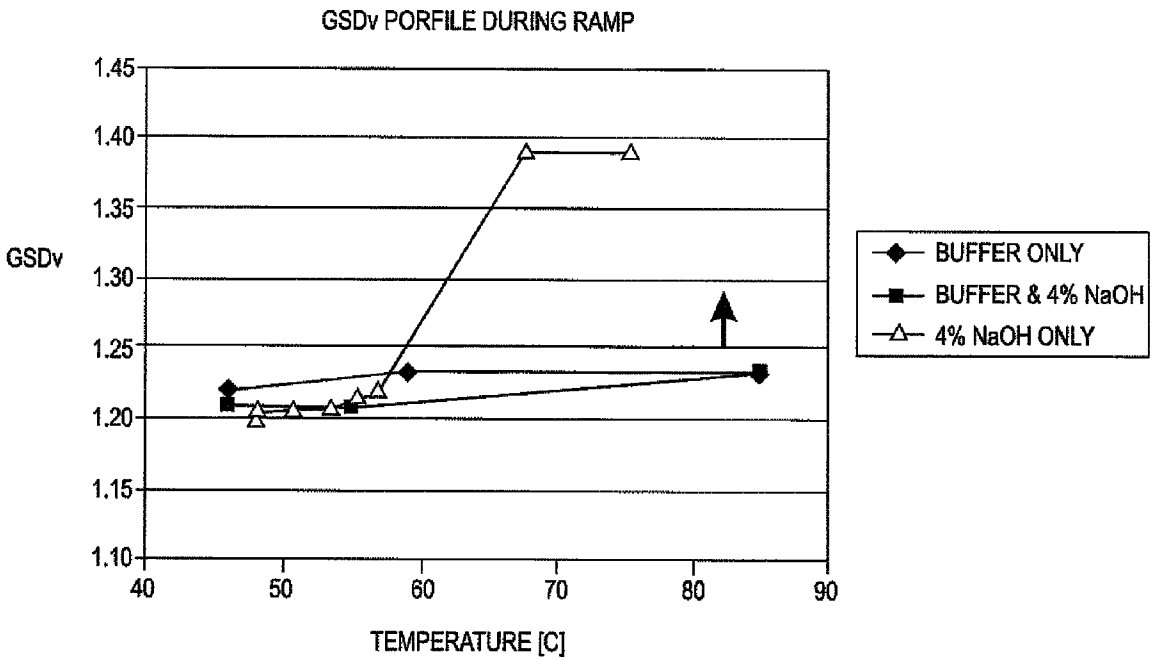
FIG. 3 illustrates exemplary GSDV profiles during the temperature ramp to coalescence.

FIGS. 1-3 illustrate the results of the above three examples. As is apparent, the batches where the buffer solution was used resulted in superior product and avoided the need of constant monitoring and numerous adjustments to the pH. FIG. 1 illustrates that the toners that used buffer; either in combination with the 4% NaOH or alone, showed a slope of −0.021 whereas the 4% NaOH solution alone shows a slope of −0.031. This indicates a 32% increase in pH instability with increasing temperature. FIG. 2 illustrates the small particle size for the toners of Examples 1 and 2 as opposed to the toner of Example 3 where only NaOH was used. FIG. 3 illustrates the distribution of the geometric size distribution (GSDv) for the toners of Examples 1 and 2, as opposed to the jump in GSDv for the toner of Example 3.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method of making toner particles, comprising:

a) mixing at least one emulsion of at least one resin, a colorant, an optional wax, and optional additives to form a slurry, wherein said at least one resin includes a first amorphous resin, a second amorphous resin different than said first amorphous resin, and a crystalline resin;

b) heating the slurry to an aggregation temperature to form aggregated particles in the slurry;

c) freezing aggregation of the particles with a buffer solution, the buffer solution comprising:

an organic compound selected from the group consisting of tris(hydroxymethyl)aminomethane ("TRIS"), Tricine, Bicine, Glycine, HEPES, Triethanolamine hydrochloride, and MOPS; and an acid selected from the group consisting of an aliphatic acid, an aromatic acid, acetic acid, citric acid, hydrochloric acid, boric acid, formic acid, oxalic acid, phthalic acid, and salicylic acid;

d) increasing a temperature of the aggregated particles and slurry to a coalescing temperature without addition of any pH adjustment agent; and then e) allowing the aggregated particles to coalesce into toner particles, wherein the freezing aggregation of the particles with the buffer solution comprises:

adjusting the pH of the slurry to about 3.5 to about 6 using the buffer to make an adjusted slurry, adding to the adjusted slurry a chelating agent, and further adjusting the pH of the adjusted slurry to about 6 to about 9 using the buffer.

2. The method of claim 1, wherein the buffer solution has a pH of from about 7 and about 12.

3. The method of claim 1, wherein the buffer solution has a pH of about 9.

4. The method of claim 1, further comprising cooling the toner particles after e).

5. The method of claim 1, further comprising washing the toner particles after e).

6. The method of claim 1, wherein the slurry pH is adjusted to about 4.5 to 5.5 to make an adjusted slurry.

7. The method of claim 1, wherein the adjusted slurry pH is adjusted to about 7 to 8.

8. The method of claim 1, wherein sodium hydroxide is used in combination with the buffer.

9. The method of claim 1, wherein the at least one resin is selected from the group consisting of styrene acrylate resins, UV curable resins, and polyester resins.

10. The method of claim 1, wherein said first amorphous resin, said second amorphous resin and said crystalline resin all comprise polyester.

* * * * *